US006507718B2

(12) United States Patent
Ohjimi et al.

(10) Patent No.: US 6,507,718 B2
(45) Date of Patent: Jan. 14, 2003

(54) METHOD AND APPARATUS FOR REDUCING ADHESION OF CARRIER TO IMAGE BEARING MEMBER

(75) Inventors: Tokuya Ohjimi, Kanagawa (JP); Kentaroh Matsumoto, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/942,593

(22) Filed: Aug. 31, 2001

(65) Prior Publication Data

US 2002/0051649 A1 May 2, 2002

(30) Foreign Application Priority Data

Aug. 31, 2000 (JP) ..... 2000-264073

(51) Int. Cl.[7] ..... G03G 15/08; G03G 21/00

(52) U.S. Cl. ..... 399/127; 399/234; 399/235; 399/270

(58) Field of Search ..... 399/127, 128, 399/234, 235, 50, 55, 168, 270

(56) References Cited

U.S. PATENT DOCUMENTS 5,155,533 A * 10/1992 Kurokawa et al. ..... 399/235
5,179,411 A * 1/1993 Yoshiuchi et al. ..... 399/46
5,512,708 A 4/1996 Takahashi et al.
5,864,733 A 1/1999 Mae et al.
6,198,895 B1 * 3/2001 Tsuda et al. ..... 399/267

FOREIGN PATENT DOCUMENTS

| | | |
|---|---|---|
| JP | 05-165287 | 7/1993 |
| JP | 09-022178 | 1/1997 |
| JP | 09-197833 | 7/1997 |
| JP | 2000-221765 | * 8/2000 |
| JP | 2000-231258 | 8/2000 |
| JP | 2001-92197 | 4/2001 |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

In an image forming apparatus having a reverse development system and using a two-component developer, respective potentials applied when charging an image bearing member and when applying a development bias to a developer bearing member are attenuated when the image bearing member is driven for an operation other than an image forming operation, compared to respective level of potentials applied when the image bearing member is driven for the image forming operation. Thus, an occurrence of an adhesion of a carrier to an image bearing member is reduced to produce a high quality image, when a power switch of the apparatus is turned off or when a door of the apparatus is opened while the image bearing member is driven for an operation other than the image forming operation, or when the apparatus is activated again after the power switch is turned off.

22 Claims, 4 Drawing Sheets

METHOD AND APPARATUS FOR REDUCING ADHESION OF CARRIER TO IMAGE BEARING MEMBER

BACKGROUND OF THE INVENTION

1. Field of the Invention

The present invention relates to a method and an apparatus for image formation, and more particularly to a method and an apparatus that can produce a high quality image by reducing an occurrence of an adhesion of a carrier to an image bearing member.

2. Discussion of the Background

Recently, a growing number of an image forming apparatuses adopt a reverse development system. In the image forming apparatus having the reverse development system, toner charged in the same polarity as that of an image bearing member, and a two-component developer including a carrier which is charged in a reverse polarity of the toner are used. An electrostatic latent image formed on a surface of the image bearing member is then developed into a toner image by applying a development bias having the same polarity as that of the toner to a developer bearing member which carries the two-component developer.

In the image forming apparatus, a pretreatment of an image forming operation (e.g., data transmission, and feeding of transfer sheet), an image forming operation (e.g., writing, development, and transfer of image), and an aftertreatment of the image forming operation (e.g., sheet discharging, and cleaning after image is transferred) are performed by driving the image bearing member.

In the above-described image forming apparatus using the two-component developer, when the image bearing member is started to drive, if the development bias is applied to the developer bearing member at the same time when the image bearing member is charged, an inconvenience, such as developing a solid black area on the image bearing member is caused because it happens that the image bearing member, passing through a developing section where the image bearing member and the developer bearing member face each other immediately after the development bias is applied, is not charged. Further, when the driving of the image bearing member is stopped, if the charging of the image bearing member is stopped at the same time when the application of the development bias is stopped, it happens that the image bearing member, which passes through the developing section immediately after the application of the development bias is stopped, is charged, resulting in an adhesion of the carrier to the image bearing member.

Thus, the time to charge the image bearing member and to apply a development bias to the developer bearing member is controlled so that the above-described inconvenience may not be caused at the developing section, when the image bearing member starts a driving or stops the driving. For example, as illustrated in FIG. 3, when the image bearing member is started to drive, an application of a development bias is controlled to be started "T" seconds after a charging of the image bearing member is started in which the image bearing member reaches the developing section from the charging section where the image bearing member opposes the charging device. Further, the application of the development bias is controlled to be stopped "T" seconds after the charging of the image bearing member is stopped, when the driving of the image bearing member is stopped. The time to charge the image bearing member and to apply the development bias is controlled as described above to obviate an occurrence of the above-described inconvenience.

Further, when an abnormal condition is encountered or when a transfer sheet is jammed while it is conveyed in the image forming apparatus, the charging and development bias application operations are not suddenly stopped. It is controlled such that the application of the development bias is stopped "T" seconds after the charging of the image bearing member is stopped as illustrated in FIG. 3 to prevent the occurrence of the above-described inconvenience.

It may happen that a user suddenly turns off a main switch of the apparatus or opens a door of the apparatus because of a production of an abnormal image, etc., while the image bearing member drives. In such a case, a supply of a voltage to a driving motor is stopped, and at the same time, the charging and development bias application operations are suddenly stopped, for safety. A rotation of the image bearing member stops after the image bearing member is rotated by a coasting of the driving motor, after the supply of the voltage to the driving motor is stopped. At this time, a carrier adheres to a portion of the image bearing member which passes the developing section by inertia because a development bias is not applied while the portion of the image bearing member is charged.

In addition, when a main switch of the apparatus is turned on or when the apparatus is activated by closing a door of the main body of the apparatus, it may happen that a portion of the image bearing member, which is kept being charged, passes the developing section before the development bias is applied. Then, the carrier may adhere to this portion of the image bearing member. The above-described actions (i.e., to turn off the main switch or to open the door of the main body suddenly while the image bearing member dives) may hardly be taken when it is obvious that a transfer sheet is inside the apparatus and an image forming operation is performed. However, these actions may often be taken when pretreatment or aftertreatment operations are performed in which a part or whole of a transfer sheet can visually be checked from the outside.

In recent years, it has become more common for an image forming apparatus is to be used as an output apparatus of a computing apparatus, such as a computer with a digitization of information. In the printer, it may happen that the image bearing member keeps on rotating due to an abnormal data input processing. When that happened, the printer is activated again after a power switch of the printer is turned off.

As is the case with the above-described image forming apparatus, a supply of a voltage to a driving motor is stopped; at the same time, the charging and development bias application operations are suddenly stopped. Thus, a carrier adheres to the image bearing member when a rotation of the image bearing member is stopped or when the printer is activated again.

When the carrier adheres to the image bearing member, an amount of the carrier decreases which may change a development characteristics. Further, the carrier adhered to the image bearing member may become caught in a gap between the image bearing member and a member that contacts a surface of the image bearing member (i.e. a cleaning blade of a cleaning device), thereby damaging the surface of the image bearing member and the cleaning blade. In addition, the carrier is conveyed to a fixing device via a transfer sheet where the carrier may damage a fixing roller, thereby seriously degrading a quality of an image.

The inventor proposed an image forming apparatus which prevents an adhesion of a carrier to an image bearing member in Japanese Patent Laid-Open Publication No. 5-165287. The adhesion of the carrier occurs when the image bearing member rotates by inertia after a supply of a voltage to a driving motor for the image bearing member is stopped while the image bearing member drives. The supply of the voltage to the driving motor is stopped when a main switch of the apparatus is turned off or a door of the apparatus is opened.

The image forming apparatus proposed in the above-described publication includes a delay control device which keeps on applying a development bias for a predetermined period of time, when the door of the a main body of the apparatus is suddenly opened. The apparatus further includes an internal power source and the delay control device. The internal power source supplies a power to apply the development bias, and the delay control device keeps on applying the development bias for the predetermined period of time, when the main switch is suddenly turned off.

An attempt has been made to accomplish a developing device using a two-component developer, in which a toner density of the developer is controlled to be within a constant range by taking toner into the developer with a movement of the developer without having a toner density detection device. As an example of the above attempt, the inventor proposed a developing device in Japanese Patent Laid-Open Publication Nos. 9-22178 and 9-197833. The developing device includes a regulating member to regulate an amount of a developer which is carried and conveyed by a developer bearing member, a developer container to contain a developer scraped by the regulating member, and a toner container, which is provided adjacent to the developer container, to supply the developer bearing member with the toner. In the developing device, a contacting state between the developer and the toner is changed by changing the toner density of the developer carried by the developer bearing member in order to change a state of the developer to take the toner.

In the developing device, when the toner density decreases as the toner is supplied to the developer carried by the developer carrying member from the toner container, a conveyance resistance of the developer in the developer container to the developer carried by the developer bearing member increases, thereby causing a pileup phenomenon in the conveyance of the developer. This pileup phenomenon forms a stagnation of the developer at a toner supply outlet through which the toner container is in communication with the developer container.

A supply of toner is regulated in a constant amount because the stagnation of the developer regulates an amount of the toner to be taken by the developer carried by the developer bearing member. The toner and carrier in the developer are stirred by a circulative movement of the developer in the developer container, resulting in an uniformed toner density. Thus, the toner density of the developer is self-controlled within a constant range by taking the toner into the developer with the movement of the developer without using the toner density detection device. Further, an agitating member, such as a paddle and a screw can be eliminated because the toner is taken into the developer with the movement of the developer, which is advantageous to downsize the developing device and to reduce costs of the developing device.

In the above-described developing device having a toner density self-control system, a target toner density can be controlled by changing a volume of a developer which is accomplished by changing an amount of a carrier contained in a developer container. More specifically, when the amount of the carrier decreases less than a certain level, the volume of the developer decreases. Thus, the density of the toner increases because an amount of the toner taken into the developer increases. To the contrary, when the amount of the carrier increases more than the certain level, the volume of the developer increases. Thus, the density of the toner decreases because the amount of the toner taken into the developer decreases.

Therefore, it is very much important to control an amount of the carrier such that the amount of the carrier contained in the developer container in the initial stage does not change in order to maintain the toner density within a proper range with respect to time. Further, the developing device having the toner density self-control system can be downsized compared to a developing device using a two-component developer in which toner is replenished by detecting a toner density using a conventional toner density detection device, and the developer is stirred in a developer container using a paddle or a screw. Therefore, an amount of a carrier to be contained in the developing device tends to be less.

In the developing device having the toner density self-control system, when the above-described carrier adhesion is repeated, the amount of the carrier in the developer container decreases. The toner density then increases which may produce an abnormal image, such as an image having a soiled background. In addition, an effect of a decrease of an amount of a carrier becomes more pronounced, since the amount of the carrier in the developer container is small.

SUMMARY OF THE INVENTION

The present invention has been made in view of the above-mentioned and other problems and addresses the above-discussed and other problems.

The present invention advantageously provides a novel image forming apparatus having a reverse development system and using a two-component developer, and method, wherein an occurrence of an adhesion of a carrier to an image bearing member is reduced to produce a high quality image, when a power switch of the apparatus is turned off or when a door of the apparatus is opened while the image bearing member is driven for an operation other than an image forming operation, or when the apparatus is activated again after the power switch is turned off.

According to an example of the present invention, an image forming apparatus includes an image bearing member, a charging device to charge an image bearing member, a latent image forming device to form an electrostatic latent image on a surface of the image bearing member, and a developing device having a reverse development system to develop the electrostatic latent image with a two-component developer including toner charged in the same polarity of the image bearing member and a carrier charged in a reverse polarity of the toner by applying a development bias having the same polarity of the toner to a developer bearing member which carries the two-component developer.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
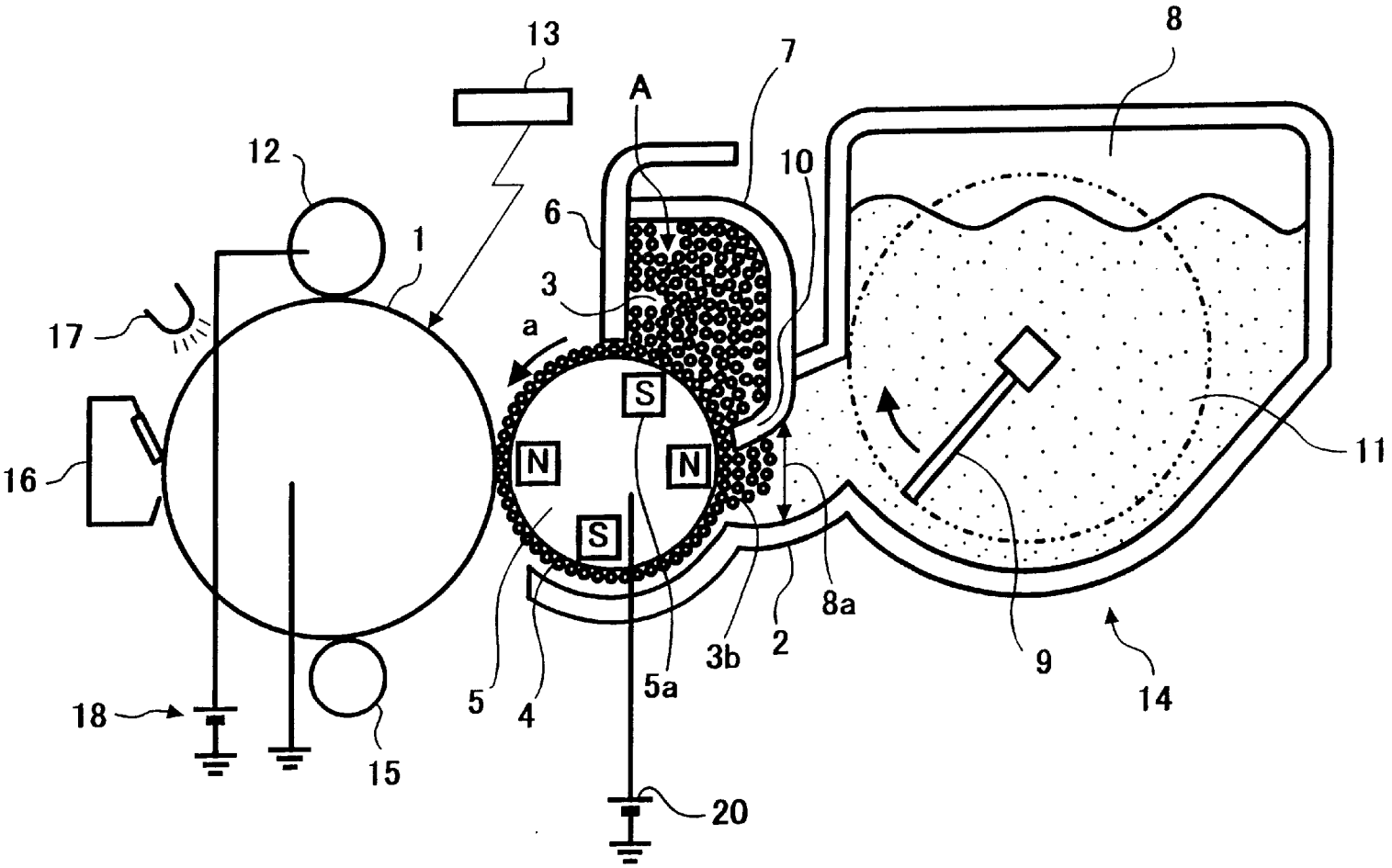
FIG. 1 is a schematic drawing illustrating a construction of a copying machine according to a first example of the present invention.
Figure 2:
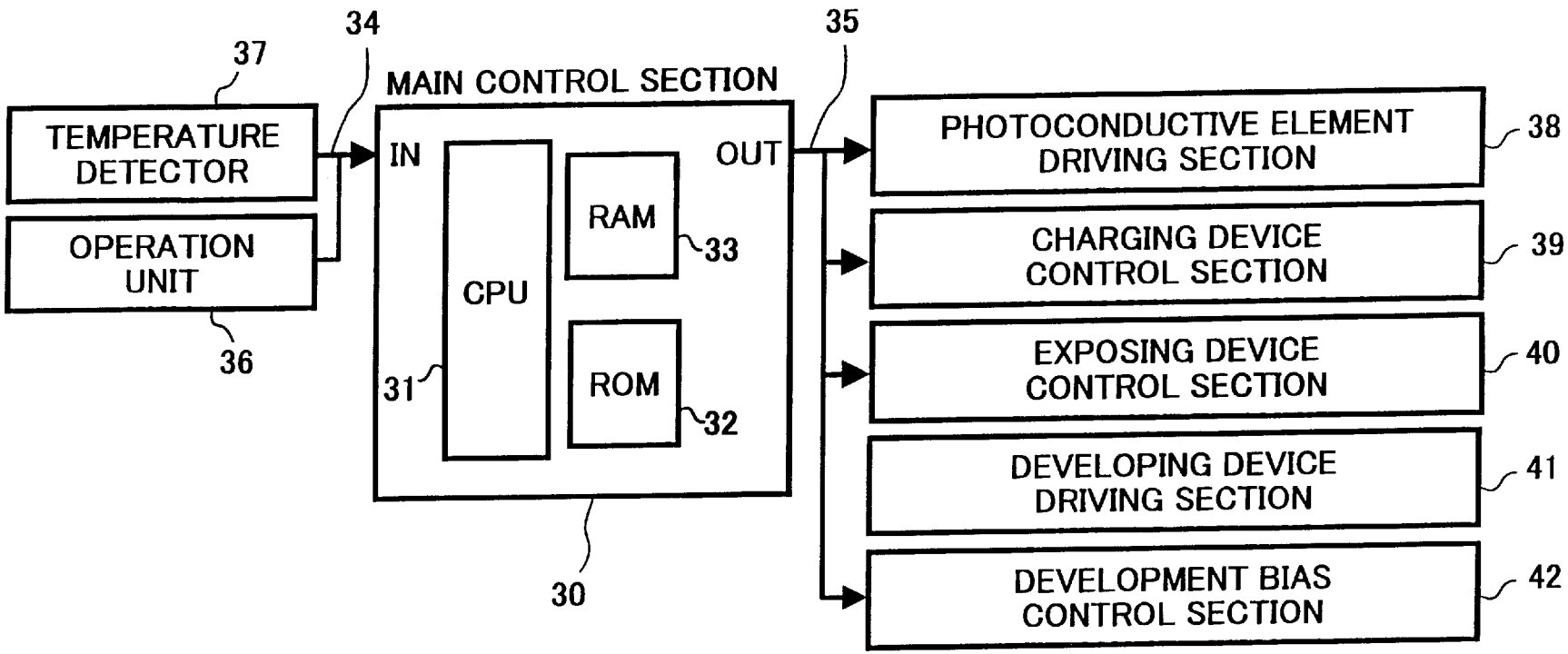
FIG. 2 is a block diagram illustrating a control section of the copying machine.
Figure 3:
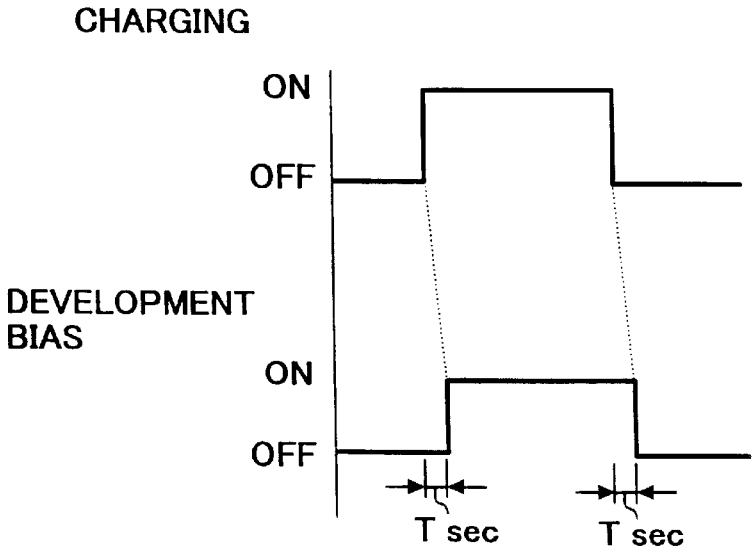
FIG. 3 PRIOR ART
FIG. 3 is a timing diagram illustrating the time to charge and apply a development bias in a conventional copying machine.

Referring now to the drawings, wherein like reference numerals designate identical or corresponding parts throughout the several views, a first example of the present invention is described below. In the first example, the present invention is applied to a digital electrophotographic copying machine (hereinafter referred to as a copying machine) as an image forming apparatus. FIG. 1 is a schematic drawing illustrating a construction of a copying machine according to the first example of the present invention. FIG. 2 is a block diagram illustrating a control section of the copying machine. Referring to FIG. 1, the construction and an operation of the copying machine is explained below. A charging roller 12 as a charging device, an exposure device 13, a developing device 14, a transfer device 15, a cleaning device 16, and discharging device 17 are provided around a photoconductive element 1 which is an image bearing member. An electroconductive substrate of the photoconductive element 1 is grounded. The photoconductive element 1 is rotatably driven by a motor (not shown) to form an image by performing below-described processes.

The photoconductive element 1 is uniformly charged by the charging roller 12, to which a voltage is supplied from a power source for charging 18. A surface of the photoconductive element 1 is then irradiated with beam light emitted from the exposure device 13 to form an electrostatic latent image thereon. The electrostatic latent image is developed into a visible toner image by the developing device 14 described below. The toner image is then electrostatically transferred onto a transfer sheet by the transfer device 15. Residual toner remaining on the surface of the photoconductive element 1 without being transferred onto the transfer sheet is recovered by the cleaning device 16. A residual charge of the photoconductive element 1 is also discharged by the discharging device 17 for the following image forming operation.

Referring to FIG. 2, a control system of the copying machine according to the first example is described below. A main control section 30 includes a CPU 31, a ROM 32, a RAM 33 which is used in a work area, and input-output ports (I/O) 34 and 35. The CPU 31 performs an overall signal process and the ROM 32 stores a program to be performed by the CPU 31. Printing conditions including various printing modes, the number of prints, etc., are confirmed when a setting signal is input to the CPU 31 from an operation unit 36, provided in a main body of the copying machine, via the I/O 34.

Further, when a detection signal is input to the CPU 31 from a temperature detector 37 via the I/O 34, conditions for forming a toner image on a surface of the photoconductive element 1 is computed based on the detection signal. Then, a control signal, which is related to a toner image forming operation on the surface of the photoconductive element 1, is transmitted to a photoconductive element driving section 38, a charging device control section 39, an exposing device control section 40, a developing device driving section 41, and a development bias control section 42 from the CPU 31 via the I/O 35.

Next, the developing device 14 is explained below. The developing device 14 adopts a reverse development system. In the developing device 14, an electrostatic latent image formed on a surface of the photoconductive element 1 is developed into a toner image applying a development bias having the same polarity as that of the toner to a developer bearing member which carries a two-component developer 3 (hereinafter referred to as a developer) including toner charged in the same polarity as that of the photoconductive element 1 and a carrier charged in a reverse polarity of the toner.

A construction of the developing device 14 is described below. The developing device 14 includes a developing sleeve 4, a magnet roller 5, a doctor blade 6, a developer container 7, a toner hopper 8, a pre-doctor blade 10, and a developer housing 2. The developing sleeve 4 includes a non-magnetic material and serves as a developer bearing member. The magnet roller 5 is fixedly provided inside the developing sleeve 4 as a magnetic field generating device. The doctor blade 6 is a first developer regulating member which regulates an amount of a developer carried and conveyed by the developing sleeve 4.

The developer container 7 includes a developer accommodating section A to accommodate a developer scraped by the doctor blade 6. The toner hopper 8 serves as a toner container and is arranged adjacent to the developer container 7 to provide toner to a developer carried by the developing sleeve 4. The pre-doctor blade 10 is provided at an upstream side of the doctor blade 6 in a conveying direction of a developer carried by the developing sleeve 4. The pre-doctor blade 10 serves as a second developer regulating member. The developer housing 2 includes an opening at the side of the photoconductive element 1. The opening is configured to surround a lower portion of the developing sleeve 4. The doctor blade 6 is spaced at a constant distance from the developing sleeve 4 to regulate a thickness of a developer layer on the developing sleeve 4. The developer container 7 including the developer accommodating section A is arranged at an upstream side of the doctor blade 6 in a conveying direction of a developer in order to contain a developer 3 scraped by the doctor blade 6.

The magnet rollers 5 generates a magnetic pole 5*a* at a position opposed to the developer accommodating section A to carry the developer 3 in the developer accommodating section A on the developing sleeve 4. Further, the toner hopper 8 is arranged adjacent to the developer container 7 as a toner container. A lower end portion of the developer container 7 functions as the pre-doctor blade 10 which is spaced at a constant distance from the developing sleeve 4. The pre-doctor 10 regulate a thickness of a layer of the developer 3 carried by a surface of the developing sleeve 4. The pre-doctor 10 is positioned at an upstream side of the doctor blade 6 in a conveying direction of the developer 3.

A toner supply outlet 8*a* is formed between the pre-doctor blade 10 and the developer housing 2 to supply the developer 3 with toner 11 contained in the toner hopper 8. An agitator 9 is provided in the toner hopper 8. The agitator 9 conveys toner to the toner supply outlet 8*a* while agitating the toner. A position of a rotating shaft and a length of a wing of the agitator 9 are adjusted so that an edge of the wing may not touch the developer 3 as shown by a two-dotted and dashed line in FIG. 1.

Next, a behavior of the developer 3 in the developing device 14 is described below. In the developing device 14, a thickness of a layer of the developer 3 layered on the developing sleeve 4 in the developer accommodating section A is regulated by the doctor blade 6 while the developing sleeve 4 rotates in a direction indicated by an arrow "a" in FIG. 1. The layer of the developer 3 with the thickness regulated is then conveyed to a developing section where the developing sleeve 4 opposes the photoconductive element 1.

Then, a predetermined development bias with the same polarity as that of toner is applied to the developing sleeve 4 by a power source for development bias 20. Only toner in the developer 3, which is carried by the developing sleeve 4, is supplied to an electrostatic latent image formed on a surface of the photoconductive element 1 so as to form a toner image. The developer 3 is conveyed to the toner supply outlet 8*a* with a rotation of the developing sleeve 4. The developer 3 is then conveyed to the developer accommodating section A after taking in the fresh toner 11 supplied through the toner supply outlet 8*a*.

An internal pressure of the developer 3, which includes the fresh toner 11, increases at a position where a thickness of the developer 3 is regulated by the doctor blade 6, and the toner included in the developer 3 is frictionally charged. Thus, the toner included in the developer 3 carried by the developing sleeve 4 is charged by the internal pressure of the developer 3 in the developer accommodating section A. Then, a complicated stirring conveyance mechanism using a paddle or a screw to stir or charge a developer is not required. A part of the developer 3, which is scraped by the doctor blade 6 without being conveyed to the developing section, moves toward the toner supply outlet 8*a* of the toner hopper 8 in the developer accommodating section A by the internal pressure and the gravity of the developer 3. The developer 3, which has moved near to the toner supply outlet 8*a,* is regulated by the pre-doctor blade 10, and is attracted to a side of the developing sleeve 4 by a magnetic force of the magnetic pole 5*a*. The developer 3 circulates in the developer accommodating section A by being conveyed toward the doctor blade 6 with a rotation of the developing sleeve 4.

In the developing device 14, the larger an amount of toner to be supplied to the developer 3, which increases a toner density, the larger a volume of the developer 3. Thus, the developer 3 regulated by the pre-doctor blade 10 forms a developer stagnated portion 3*b,* which covers the opening of the toner supply outlet 8*a*. Therefore, a less amount of toner is taken into the developer 3 carried by the developing sleeve 4. A toner density of the developer 3 is then maintained at a level not greater than a constant density.

To the contrary, the volume of the developer 3 decreases when the toner density of the developer 3 decreases. A predetermined amount of toner is taken into the developer 3 carried by the developing sleeve 4 because the developer stagnated portion 3*b* does not cover the toner supply outlet 8*a,* thereby maintaining the toner density of the developer 3 at the level not less than the constant density. A complicated toner density control mechanism using a toner density sensor and a toner replenish member is not required because a toner density is self-controlled within a constant range.

Further, in the developing device 14, a target toner density range can be controlled by changing a volume of a developer, which is accomplished by changing an amount of a carrier contained in the developer accommodating section A in the initial stage. More specifically, when the amount of the carrier is decreased, the volume of the developer 3 is decreased. Thus, the amount of the toner to be taken into the developer 3 from the toner supply outlet 8*a* increases, resulting in an increase in the toner density of the developer 3.

Contrarily, when the amount of the carrier is increased, the volume of the developer 3 is increased. The amount of the toner to be taken into the developer 3 from the toner supply outlet 8*a* is decreased, resulting in an decrease in the toner density of the developer 3.

Figure 4:
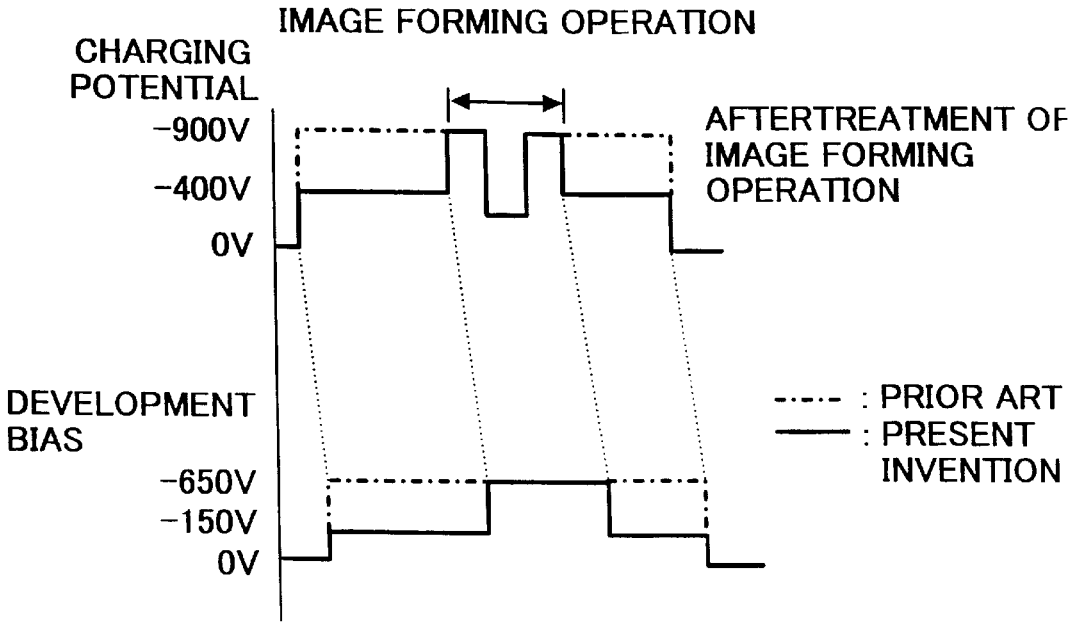
FIG. 4 is a timing diagram illustrating the time to charge and apply a development bias in the copying machine according to the first example.

Next, the time to charge the photoconductive element 1 and to apply a development bias to a developer carrying member is described below referring to a timing diagram illustrated in FIG. 4. In the above-described copying machine, a pretreatment of an image forming operation (e.g., data transmission, feeding of transfer sheet), an image forming operation (e.g., writing, development, transfer of image), and an aftertreatment of the image forming operation (e.g., transfer sheet discharging, cleaning after image is transferred) are performed by driving the photoconductive element 1.

The timing is controlled such that (1) when a rotation of the photoconductive element 1 is started, the photoconductive element 1, which passes through a developing section immediately after a development bias is applied, is charged so that a development of a solid black area is not caused, and (2) when the rotation of the photoconductive element 1 is stopped, the photoconductive element 1, which passes through the developing section immediately after the application of the development bias is stopped, is not charged so that a carrier may not adheres to the photoconductive element 1.

More specifically, as illustrated in FIG. 2, the CPU 31 transmits a control signal to the photoconductive element driving section 38, the charging device control section 39, and the development bias control section 42 via the I/O 35. The control signal instructs that the development bias is applied when the photoconductive element 1 reaches a developing section from a charging section after the charging is started, and that the application of the development bias is stopped when the photoconductive element 1 reaches the developing section from the charging section after the charging is stopped. The photoconductive element driving section 38, the charging device control section 39, and the development bias control section 42 controls a main motor (not shown) to drive the photoconductive element 1, the power source for charging 18, and the power source for development bias 20, respectively.

Even when an abnormal condition is encountered or when a transfer sheet is jammed while the transfer sheet is conveyed in the copying machine, a charging and a development bias application operations are not suddenly stopped. The development bias application operation is controlled to be stopped when the photoconductive element 1 reaches the developing section from the charging section after the charging operation is stopped.

Further, in the copying machine according to the first example, respective potentials of the charging and the development bias are attenuated when the photoconductive element 1 is driven for an operation other than an image forming operation (i.e., when a pretreatment or an aftertreatment processes are performed) compared to potentials applied when an image forming operation is performed.

More specifically, as illustrated in FIG. 2, the CPU 31 transmits a control signal to the charging device control section 39 and the development bias control section 42 via the I/O 35 instructing that respective attenuated potentials are applied when the photoconductive element is charged and when the development bias is applied for the operation other than the image forming operation, compared to potentials applied for the image forming operation. The charging device control section 39 and the development bias control section 42 controls an output of the power source for charging 18 and the power source for development bias 20, respectively.

A supply of a voltage to a main motor is stopped when a door of the apparatus is opened or when a main power switch of the apparatus is turned off. Then, the photoconductive element 1 stops a rotation after rotating by inertia, after the voltage supply to the main motor is stopped. A portion of the photoconductive element 1, which passes the developing section by the rotation of the photoconductive element 1 by inertia, is charged in an attenuated value of a potential compared to that charged when an image forming operation is performed.

Figure 5:
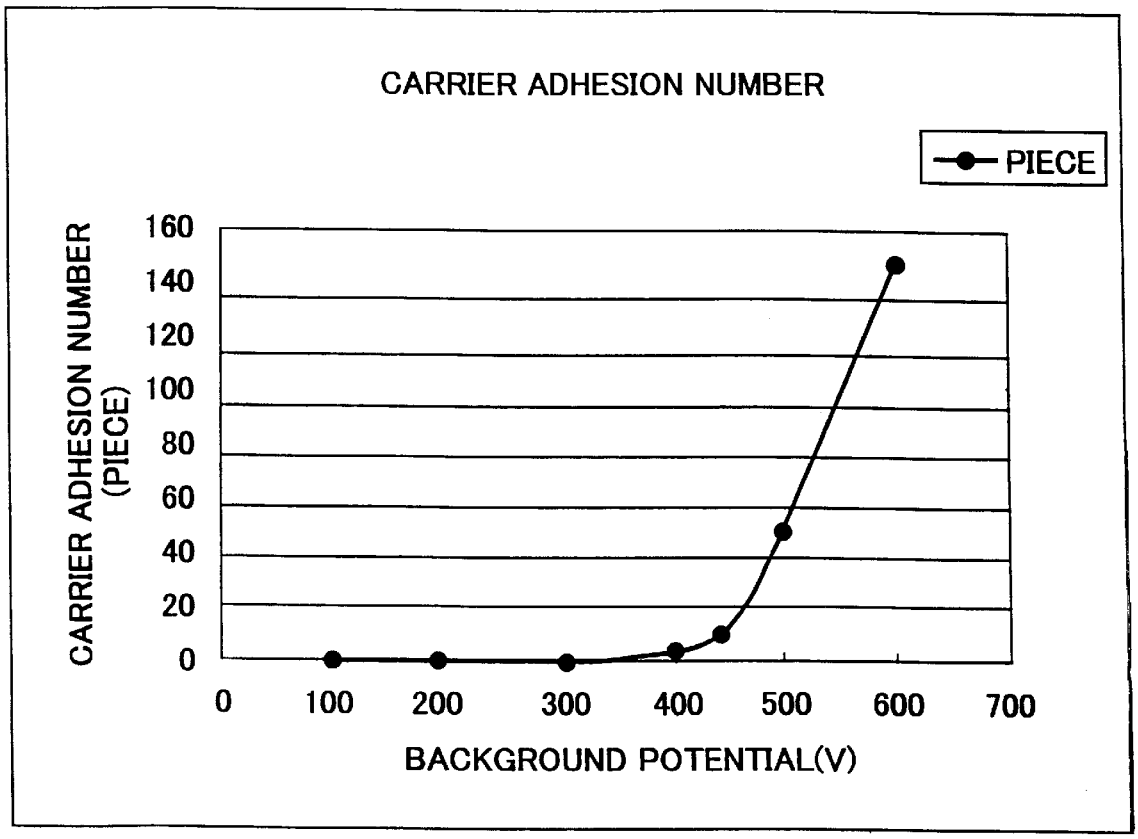
FIG. 5 is a diagram illustrating a relationship between a background potential and the number of carriers adheres to the image bearing member.

A background potential (i.e., a development bias—a charging potential) is decreased compared to that when the photoconductive element 1 is charged in the same potential applied when an image forming operation is performed, even if a potential of a development bias is zero as an application of the development bias is stopped. The larger the background potential, the larger the number of carriers adheres to the photoconductive element 1, as illustrated in FIG. 5. Therefore, an occurrence of an adhesion of a carrier to the photoconductive element 1 is reduced by decreasing a level of the background potential.

Next, a more specific example of the copying machine according to the first example of the present invention is described below.

An example

In the copying machine, potentials applied for a charging and a development bias in an image forming operation are controlled to be set at −900 volts and −650 volts, respectively while these are set at −400 volts and −150 volts, respectively when the photoconductive element 1 is driven for operations other than the image forming operation (i.e., pretreatment and aftertreatment operations). In this condition, a background soiling is not caused because the background potential when the photoconductive element 1 is driven for the operation other than the image forming operation is 250 volts which is equal to the background potential when the photoconductive element 1 is driven for the image forming operation. An adhesion of a carrier to the photoconductive element 1 is not confirmed when the photoconductive element 1 is examined after an usual image forming operation is performed under the above-described condition. The toner density measured at this time is 11 wt %.

Further, the adhesion of the carrier to the photoconductive element 1 is not confirmed when the photoconductive element 1 is examined after an image forming operation is suspended by causing a paper jam forcibly. Again, the adhesion of the carrier to the photoconductive element 1 is hardly confirmed when the photoconductive element 1 is examined after a main switch of the machine is turned off while an aftertreatment is performed. In this example, a changing potential in the pretreatment and aftertreatment operations is controlled to be set at −400 volts while a development bias is set at −150 volts. The background potential of a portion of the photoconductive element 1, which passes the developing section by a rotation of the photoconductive element 1 by inertia, is 400 volts even when the main switch of the machine is suddenly turned off and the development bias decreases to zero volts.

A relationship between a background potential and a carrier adhesion number illustrated in FIG. 5 indicates that an adhesion of a carrier hardly occurs when the background potential is decreased down to 400 volts. In addition, a toner density is stably measured at 11 wt % when an usual image forming operation is performed after an ON/OFF operation of the main switch is repeated several times. Thus, it can be proved that a change in a density of toner, which is caused by a decrease in an amount of a carrier due to an adhesion of the carrier to the photoconductive element 1, is prevented. Further, a high quality image without having a soiled background is obtained.

A condition for the development in the above-described example is described below.

<A mechanical condition>

Photoconductive element linear velocity: 120 mm/sec.

Gap between the developing sleeve and the photoconductive element: Gp 0.3~0.5 mm.

Gap between the developing sleeve and the doctor blade: Gp 0.3~0.5 mm.

Gap between the developing sleeve and the pre-doctor blade : Gp 0.5~1.5 mm.

Development sleeve diameter: 16ϕ.

Ratio of the developing roller linear velocity to the photoconductive element linear velocity: 1.5~3.0

<A developing condition>

<When an image forming operation is performed>

Charging potential : −850~−950 volts

Development bias: −600~−700 volts

<When the photoconductive element is driven for an operation other than the image forming operation>

Charging potential: −100~−450 volts

Development bias: 0~−300 volts

<A developer>

Carrier: magnetite or iron 40~50 μm

Toner: magnetic substance quantity: 15~40 wt % silica quantity: 0.5~1.0 wt %

Toner coverage for carrier: 50~120%

Q/M (charge to particle mass): 10~30 μc/g

A comparative example

As an example to be compared, an adhesion of a carrier in a conventional copying machine is explained below referring to the timing diagram illustrated in FIG. 4. In the conventional copying machine, a start and stop of charging and development bias application operations are performed in a similar timing to that for the copying machine in the first example of the present invention. In the conventional copying machine, a same level of potential as that applied when an image forming operation is performed is applied to charge and to apply a development bias even when a pretreatment or am aftertreatment operation is performed.

More specifically, the charging potential of −900 volts and the development bias of −650 volts, which are applied when the image forming operation is performed, are applied even when the photoconductive element 1 is driven for an operation other than the image forming operation (i.e., pretreatment and aftertreatment operations). Thus, when a user opens a door of the machine or turns off a main switch of the machine, which stops the charging and the application of the development bias, while the photoconductive element is driven for the operation other than the image forming operation, a portion of the photoconductive element 1 which is rotated by inertia is charged in the potential of −900 volts, which is the same potential as that applied in the image forming operation, while no development bias is applied. Therefore, a background potential of this portion is 900 volts.

When the photoconductive element 1 is examined after the main switch of the machine is turned off while an aftertreatment is performed, an adhesion of a carrier is confirmed. When an image forming operation is performed after an ON/OFF operation of the main switch is repeated, a low quality image having a soiled background is produced. It can be presumed that this inferior image is produced because a toner density is increased due to a decrease in an amount of a carrier to be contained in the developer accommodating section A of the developing device 14. The decrease of the amount of the carrier is caused by an adhesion of a carrier to the photoconductive element 1.

Next, a second example of the present invention applied to an image output apparatus i.e., a printer is described below. In the printer, an image is output based on data provided from a computing apparatus, such as a computer unlike a copying machine described in the first example. Because a basic construction of the printer, and a basic construction and operation of a developing device are identical to those described in the first example, a description will be omitted.

As is the case with the first example, a charging and a development bias application operations are performed in the same timing. Further, respective potentials applied when charging a photoconductive element and applying a development bias to a developer bearing member are attenuated when the photoconductive element is driven for an operation other than an image forming operation (i.e., pretreatment and aftertreatment operations), compared to respective level of potentials applied when the photoconductive element is driven for the image forming operation. Thus, a background potential decreases, even if the development bias becomes zero volts when a power switch is suddenly turned off.

Figure 6:
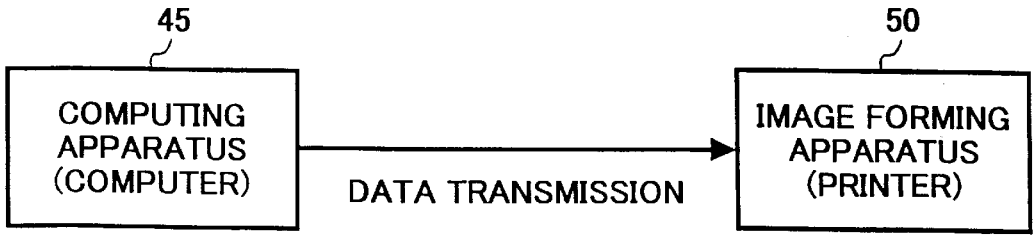
FIG. 6 is a block diagram illustrating a data transmission to a printer according to a second example of the present invention.

In the printer, a printing JOB of an arbitrary volume is transmitted from a computing apparatus 45, such as a computer to a printer 50 as illustrated in FIG. 6. When the printing JOB data is transmitted to the printer 50, it may happen that the photoconductive element 1 in the printer 50 keeps on rotating due to an abnormal data output processing. When it happened, the power switch of the printer 50 is turned off while the photoconductive element 1 is rotating, after an image forming operation is completed. Then, the power switch of the printer 50 is turned on to actuate the printer 50 again. At this time, no adhesion of a carrier to the photoconductive element 1 is confirmed.

As described above, an occurrence of the adhesion of the carrier to the photoconductive element 1 is reduced by decreasing a level of the background potential.

According to the first and the second examples, the present invention is applied to a developing device in which a toner density of a developer is controlled to be within a constant range by taking toner into the developer with a movement of the developer carried by a developing sleeve. However, the present invention can also be applied to a developing device using a two-component developer in which a toner density is controlled using a conventional toner density detection device, and the similar effect is obtained.

Obviously, numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2000-264073, filed on Aug. 31, 2000, and the entire contents thereof are herein incorporated by reference.

What is claimed is:

1. An image forming apparatus, comprising:

an image bearing member;

a charging device arranged to charge the image bearing member during an image forming operation to have a first charge and during an operation other than the image forming operation to have a second charge;

a latent image forming device arranged to form an electrostatic latent image on a surface of the image bearing member;

a reverse developing device configured to develop the electrostatic latent image with a two-component developer, wherein the two-component developer includes toner having the same polarity as the image bearing member and a carrier charged in a reverse polarity of the toner; and a developer bearing member arranged to carry the two-component developer, wherein first and second development biases of the same polarity as the toner are applied to the developer bearing member when the image bearing member is driven during the image forming operation and the operation other than the image forming operation, respectively, wherein absolute values of the constant second charge and the constant second development bias are less than the absolute values of the first charge and the first development bias, respectively, and wherein the second charge and the second development bias are constant during the operation other than the image forming operation.

2. The image forming apparatus according to claim 1, wherein the absolute value of the second charge is controlled to become a level in which the carrier does not adhere to the surface of the image bearing member even if the development bias is not applied.

3. The image forming apparatus according to claim 1, wherein a difference in the absolute value of the first charge and the first development bias is approximately equal to a difference in the absolute value of the second charge and the second development bias.

4. The image forming apparatus according to claim 1, wherein said developing device further including:

a regulating member arranged to regulate an amount of the developer carried and conveyed by the developer bearing member;

a developer container configured to accommodate the developer scraped by said regulating member; and a toner container configured to supply the developer bearing member with the toner, said toner container being arranged adjacent to said developer container, wherein a contacting state between the developer and the toner is changed by changing a toner density of the developer carried by the developer bearing member in order to change a state of the developer to take in the toner.

5. The image forming apparatus according to claim 1, wherein the image forming apparatus is a printer.

6. An image forming apparatus, comprising:

an image bearing member means;

a charging device means for charging the image bearing member such that the image bearing member means has a first charge when the image bearing member means is driven for an image forming operation and a second charge when the image bearing member means is driven for an operation other than the image forming operation;

a latent image forming device means for forming an electrostatic latent image on a surface of the image bearing member means; and a reverse developing device means for developing the electrostatic latent image with a two-component developer including toner charged in the same polarity of the image bearing member means and a carrier charged in a reverse polarity of the toner, wherein first and second development biases having the same polarity of the toner are applied to a developer bearing member, which carries the two-component developer, when the image bearing member means is driven for the image forming operation and when the image bearing member means is driven for the operation other than the image forming operation, respectively, wherein absolute values of the second charge and the second development bias are less than the absolute values of the first charge and the first development bias, respectively, and wherein the second charge and the second development bias are constant during the operation other than the image forming operation.

7. The image forming apparatus according to claim 6, wherein the absolute value of the second charge is controlled to become a level in which the carrier does not adhere to the surface of the image bearing member means even if the development bias is not applied.

8. The image forming apparatus according to claim 6, wherein a difference in the absolute values between the first charge and the first development bias is approximately equal to a difference in the absolute values between the second charge and the second development bias.

9. The image forming apparatus according to claim 6, wherein said developing device means further including:

a regulating member means for regulating an amount of the developer carried and conveyed by the developer bearing member;

a developer container means for accommodating the developer scraped by said regulating member; and a toner container means for supplying the developer bearing member with the toner, said toner container means being arranged adjacent to said developer container means, wherein a contacting state between the developer and the toner is changed by changing a toner density of the developer carried by the developer bearing member in order to change a state of the developer to take in the toner.

10. A method for forming an image, comprising:

charging an image bearing member such that the image bearing member has a first charge for an image forming operation and a second charge for an operation other than the image forming operation;

forming an electrostatic latent image on a surface of the image bearing member;

applying first and second development biases having the same polarity of toner to a developer bearing member when the image bearing member is driven during the image forming operation and the operation other than the image forming operation, respectively; and developing the electrostatic latent image formed on the surface of the image bearing member with the two-component developer, wherein the two-component developer includes the toner having the same polarity as the image bearing member and a carrier charged in a reverse polarity of the toner, wherein the absolute values of the second charge and the second development bias are less than the absolute values of the first charge and the first development bias, respectively, and wherein the second charge and the second development bias are constant during the operation other than the image forming operation.

11. The method according to claim 10, wherein the absolute value of the second charge is a level such that the carrier does not adheres to the surface of the image bearing member even if the development bias is not applied.

12. The method according to claim 10, wherein a difference in the absolute value of the first charge and the first development bias is approximately equal to a difference in the absolute values of the second charge and the second development bias.

13. The method according to claim 10, wherein the method for developing the electrostatic latent image further comprises:

regulating an amount of the developer carried and conveyed by the developer bearing member;

accommodating the developer scraped by said regulating member;

supplying the developer bearing member with the toner; and changing a contacting state between the developer and the toner by changing a toner density of the developer carried by the developer bearing member so as to change a state of the developer to take in the toner.

14. An image forming apparatus, comprising:

an image bearing member;

a charging device arranged to charge the image bearing member during an image forming operation to have a first charge and during an operation other than the image forming operation to have a second charge;

a latent image forming device arranged to form an electrostatic latent image on a surface of the image bearing member;

a reverse developing device configured to develop the electrostatic latent image with a two-component developer, wherein the two-component developer includes toner having the same polarity as the image bearing member and a carrier charged in a reverse polarity of the toner; and a developer bearing member arranged to carry the two-component developer, wherein first and second development biases of the same polarity as the toner are applied to the developer bearing member when the image bearing member is driven during the image forming operation and the operation other than the image forming operation, respectively, wherein absolute values of the second charge and the second development bias are less than the absolute values of the first charge and the first development bias, respectively, and wherein the absolute value of the second charge is controlled to become a level in which the carrier does not adhere to the surface of the image bearing member even if the development bias is not applied.

15. The image forming apparatus according to claim 14, wherein a difference in the absolute value of the first charge and the first development bias is approximately equal to a difference in the absolute value of the second charge and the second development bias.

16. The image forming apparatus according to claim 14, wherein said developing device further comprises:

a regulating member arranged to regulate an amount of the developer carried and conveyed by the developer bearing member;

a developer container configured to accommodate the developer scraped by said regulating member; and a toner container configured to supply the developer bearing member with the toner, said toner container being arranged adjacent to said developer container, wherein a contacting state between the developer and the toner is changed by changing a toner density of the developer carried by the developer bearing member in order to change a state of the developer to take in the toner.

17. An image forming apparatus, comprising:

an image bearing member means;

a charging device means for charging the image bearing member such that the image bearing member means has a first charge when the image bearing member means is driven for an image forming operation and a second charge when the image bearing member means is driven for an operation other than the image forming operation;

a latent image forming device means for forming an electrostatic latent image on a surface of the image bearing member means; and a reverse developing device means for developing the electrostatic latent image with a two-component developer including toner charged in the same polarity of the image bearing member means and a carrier charged in a reverse polarity of the toner, wherein first and second development biases having the same polarity of the toner are applied to a developer bearing member, which carries the two-component developer, when the image bearing member means is driven for the image forming operation and when the image bearing member means is driven for the operation other than the image forming operation, respectively, wherein absolute values of the second charge and the second development bias are less than the absolute values of the first charge and the first development bias, respectively, and wherein the absolute value of the second charge is controlled to become a level in which the carrier does not adhere to the surface of the image bearing member means even if the development bias is not applied.

18. The image forming apparatus according to claim 17, wherein a difference in the absolute values between the first charge and the first development bias is approximately equal to a difference in the absolute values between the second charge and the second development bias.

19. The image forming apparatus according to claim 17, wherein said developing device means further comprises:

a regulating member means for regulating an amount of the developer carried and conveyed by the developer bearing member;

a developer container means for accommodating the developer scraped by said regulating member; and a toner container means for supplying the developer bearing member with the toner, said toner container means being arranged adjacent to said developer container means, wherein a contacting state between the developer and the toner is changed by changing a toner density of the developer carried by the developer bearing member in order to change a state of the developer to take in the toner.

20. A method for forming an image, comprising:

charging an image bearing member such that the image bearing member has a first charge for an image forming operation and a second charge for an operation other than the image forming operation;

forming an electrostatic latent image on a surface of the image bearing member;

applying first and second development biases having the same polarity of toner to a developer bearing member when the image bearing member is driven during the image forming operation and the operation other than the image forming operation, respectively; and developing the electrostatic latent image formed on the surface of the image bearing member with the two-component developer, wherein the two-component developer includes the toner having the same polarity as the image bearing member and a carrier charged in a reverse polarity of the toner, wherein the absolute values of the second charge and the second development bias are less than the absolute values of the first charge and the first development bias, respectively, and wherein the absolute value of the second charge is a level such that the carrier does not adheres to the surface of the image bearing member even if the development bias is not applied.

21. The method according to claim 20, wherein a difference in the absolute value of the first charge and the first development bias is approximately equal to a difference in the absolute values of the second charge and the second development bias.

22. The method according to claim 20, wherein the method for developing the electrostatic latent image further comprises:

regulating an amount of the developer carried and conveyed by the developer bearing member;

accommodating for the developer scraped by said regulating member;

supplying the developer bearing member with the toner; and changing a contacting state between the developer and the toner by changing a toner density of the developer carried by the developer bearing member so as to change a state of the developer to take in the toner.

* * * * *